US010606194B2

(12) United States Patent
Hamada

(10) Patent No.: US 10,606,194 B2
(45) Date of Patent: Mar. 31, 2020

(54) FIXING DEVICE THAT REDUCES GROWTH OF TONER ATTACHING ONTO SEPARATION CLAW FOR SEPARATING MEDIUM FROM FIXING DEVICE AND IMAGE FORMING APPARATUS

(71) Applicant: KYOCERA Document Solutions Inc., Osaka (JP)

(72) Inventor: Toshiyuki Hamada, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 60 days.

(21) Appl. No.: 15/872,561

(22) Filed: Jan. 16, 2018

(65) Prior Publication Data

US 2018/0253046 A1 Sep. 6, 2018

(30) Foreign Application Priority Data

Mar. 1, 2017 (JP) ..... 2017-038766

(51) Int. Cl.
*G03G 15/20* (2006.01)

(52) U.S. Cl.
CPC ..... *G03G 15/2028* (2013.01); *G03G 15/206* (2013.01)

(58) Field of Classification Search
CPC ..... G03G 15/2028; G03G 15/206; G03G 15/2085; G03G 15/2089
See application file for complete search history.

(56) References Cited

U.S. PATENT DOCUMENTS 6,259,881 B1 * 7/2001 Nakamura ..... G03G 15/2028 399/323
2002/0037186 A1 * 3/2002 Tanaka ..... G03G 15/2028 399/322

FOREIGN PATENT DOCUMENTS

| | | | |
|---|---|---|---|
| JP | 02-286541 | A | 11/1990 |
| JP | 2004-271760 | A | 9/2004 |
| JP | 2011-197133 | A | 10/2011 |
| JP | 2014-142459 | A | 8/2014 |

* cited by examiner

*Primary Examiner* — David M. Gray
*Assistant Examiner* — Geoffrey T Evans
(74) *Attorney, Agent, or Firm* — Stein IP, LLC

(57) ABSTRACT

A fixing device includes a heating body, a pressurizing body, a separation claw, and a supporting member. The heating body heats a medium where a toner image is formed while the heating body rotates around a shaft. The pressurizing body forms a nip with the heating body and applies pressure to the medium that passes through the nip while the pressurizing body rotates around a shaft. The separation claw includes a protrusion that contacts the medium after having passed through the nip and separates the medium from the heating body. The supporting member supports the separation claw in state of causing the separation claw into contact with the heating body. The supporting member supports the separation claw while the supporting member causes the separation claw to slide in a direction separating from the heating body when the medium is brought into contact with the protrusion to press the protrusion.

3 Claims, 13 Drawing Sheets

FIXING DEVICE THAT REDUCES GROWTH OF TONER ATTACHING ONTO SEPARATION CLAW FOR SEPARATING MEDIUM FROM FIXING DEVICE AND IMAGE FORMING APPARATUS

INCORPORATION BY REFERENCE

This application is based upon, and claims the benefit of priority from, corresponding Japanese Patent Application No. 2017-038766 filed in the Japan Patent Office on Mar. 1, 2017, the entire contents of which are incorporated herein by reference.

BACKGROUND

Unless otherwise indicated herein, the description in this section is not prior art to the claims in this application and is not admitted to be prior art by inclusion in this section.

For example, there is proposed a typical fixing device that includes fixation separation claws, distal end portions of which are pressed to an outer peripheral surface of a heating member. The fixation separation claws are arranged at intervals greater than their gaps, along an axial direction of the heating member.

SUMMARY

A fixing device according to one aspect of the disclosure includes a heating body, a pressurizing body, a separation claw, and a supporting member. The heating body heats a medium where a toner image is formed while the heating body rotates around a shaft. The pressurizing body forms a nip with the heating body and applies pressure to the medium that passes through the nip while the pressurizing body rotates around a shaft. The separation claw includes a protrusion that contacts the medium after having passed through the nip. The separation claw separates the medium from the heating body. The supporting member supports the separation claw in a state of causing the separation claw into contact with the heating body. The supporting member supports the separation claw while the supporting member causes the separation claw to slide in a direction separating from the heating body when the medium is brought into contact with the protrusion to press the protrusion.

These as well as other aspects, advantages, and alternatives will become apparent to those of ordinary skill in the art by reading the following detailed description with reference where appropriate to the accompanying drawings. Further, it should be understood that the description provided in this summary section and elsewhere in this document is intended to illustrate the claimed subject matter by way of example and not by way of limitation.

DETAILED DESCRIPTION

Figure 1:
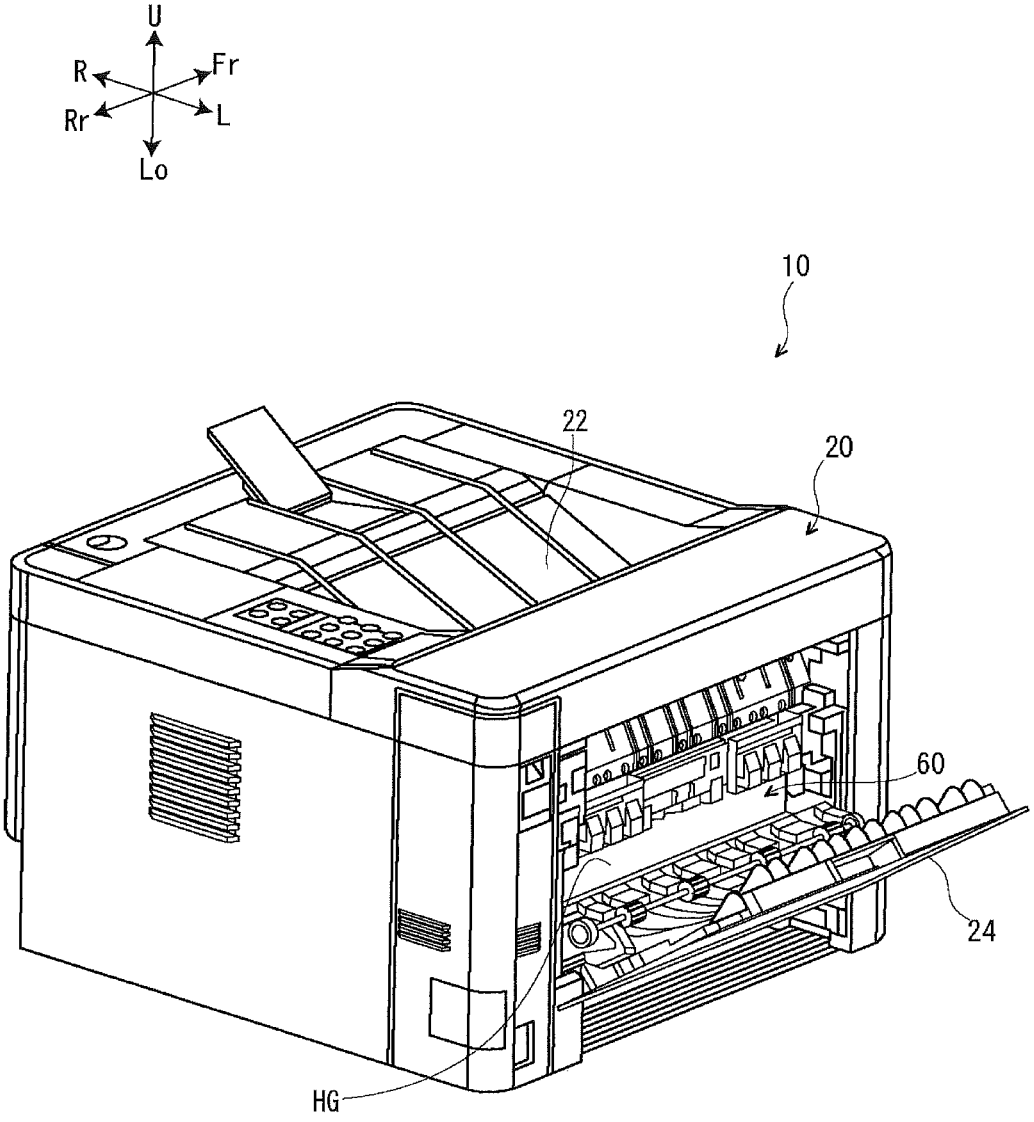
FIG. 1 obliquely illustrates an image forming apparatus according to one embodiment of the disclosure.

Example apparatuses are described herein. Other example embodiments or features may further be utilized, and other changes may be made, without departing from the spirit or scope of the subject matter presented herein. In the following detailed description, reference is made to the accompanying drawings, which form a part thereof.

The example embodiments described herein are not meant to be limiting. It will be readily understood that the aspects of the present disclosure, as generally described herein, and illustrated in the drawings, can be arranged, substituted, combined, separated, and designed in a wide variety of different configurations, all of which are explicitly contemplated herein.

Outline

The following describes an overall configuration and an image forming operation of an image forming apparatus 10 (see FIGS. 1 and 2) according to an embodiment, a configuration and a fixing operation of a fixing device 60 (see FIG. 4), which is a main part of the embodiment, and effects of the embodiment, in order of these description.

In the disclosure, in the drawings, assume that the directions indicated by an arrow Fr and an arrow Rr are respectively a front side and a back side in an apparatus depth direction, the directions indicated by an arrow R and an arrow L are respectively the right side and the left side in an apparatus width direction, and the directions indicated by an arrow U and an arrow Lo are respectively an upper side and a lower side in an apparatus height direction. This description describes the image forming apparatus 10 by assuming that a side viewed from the front side in the apparatus depth direction is the front side of the image forming apparatus 10.

Overall Configuration of Image Forming Apparatus

Figure 2:
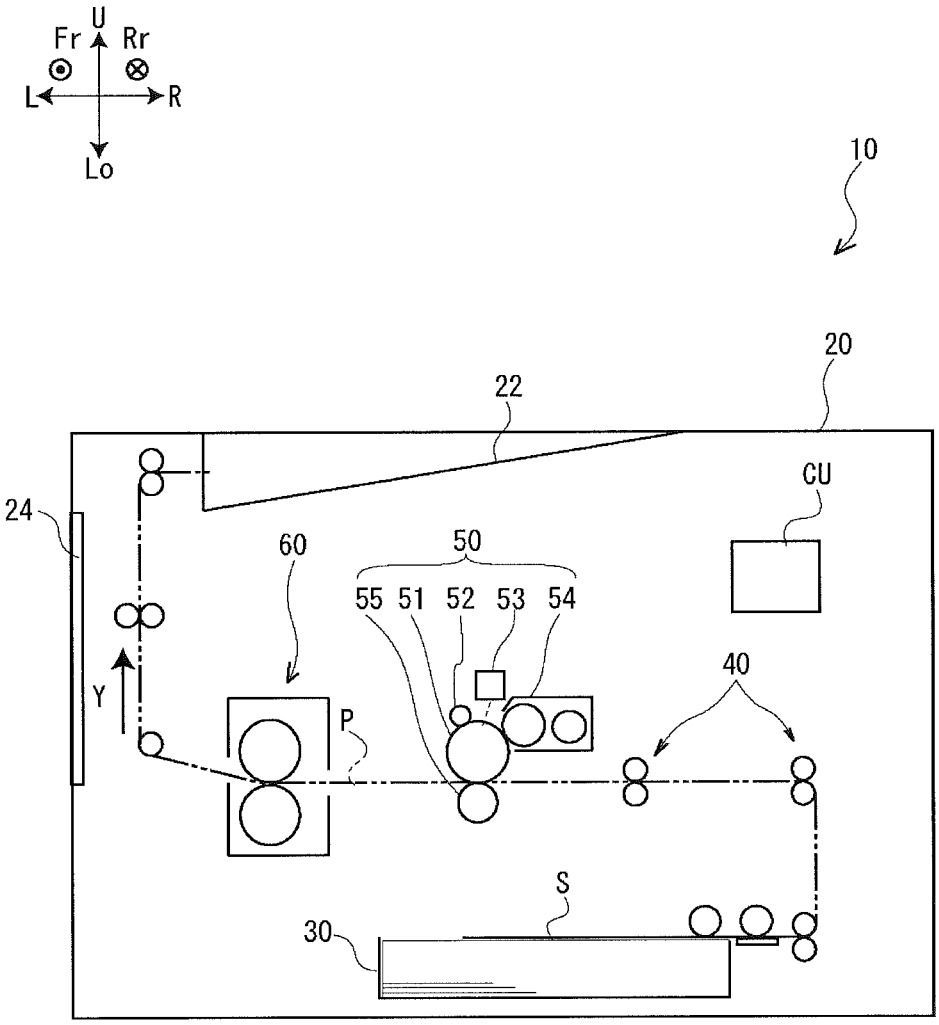
FIG. 2 illustrates a schematic diagram (a cross-sectional view) of the image forming apparatus according to the one embodiment viewed from a front side.

A description will be given of the overall configuration of the image forming apparatus 10 according to the embodiment with reference to FIGS. 1 and 2. The image forming apparatus 10 is an electrophotographic-method apparatus constituted including a main body 20, a sheet feed cassette 30, a conveyance device 40, a toner-image forming unit 50 (an exemplary forming unit), the fixing device 60, and a control unit CU.

The main body 20 has a function to internally house the sheet feed cassette 30, the conveyance device 40, the toner-image forming unit 50, the fixing device 60, and the control unit CU. The main body 20 is a box-shaped exterior. A part of the top surface of the main body 20 includes a discharge tray 22 where a medium S with a toner image fixed (with an image formed) is discharged. A lid 24 is located on the left end surface of the main body 20 viewed from the front side, and the fixing device 60, which will be described later, is removably attachable to the main body 20 in a state where the lid 24 is tilted (see FIG. 1).

The sheet feed cassette 30 is arranged in a lower side of the main body 20 and houses the medium S, where an image is formed, in a stacked state. The conveyance device 40 has a function to convey the medium S housed in the sheet feed cassette 30 up to the discharge tray 22 from the sheet feed cassette 30 along a conveying path P. The conveyance device 40 includes a plurality of driven rollers and drive rollers, and a driving source (not illustrated) that drives the plurality of drive rollers. Here, a direction that an arrow Y in the drawings points is a conveyance direction of the medium S.

The toner-image forming unit 50 has a function to form a toner image to the medium S conveyed by the conveyance device 40. The toner-image forming unit 50 is arranged in the center inside the main body 20 viewed from the front side. The toner-image forming unit 50 is constituted including a photoreceptor 51, a charging apparatus 52, an exposure apparatus 53, a developing device 54, and a transfer roller 55.

The toner-image forming unit 50 charges the photoreceptor 51 rotating around a shaft by the charging apparatus 52, exposes the photoreceptor 51 by the exposure apparatus 53 to form a latent image, develops the latent image as a toner image by the developing device 54, and transfers the toner image to the medium S by the transfer roller 55. As described above, the toner-image forming unit 50 forms a toner image to the medium S.

The fixing device 60 has a function to fix the toner image to the medium S (the medium with the toner image formed) where the toner image is transferred by the toner-image forming unit 50. The fixing device 60 is arranged on the left side inside the main body 20 viewed from the front side. Since the fixing device 60 is a main part of the embodiment, the specific configuration of the fixing device 60 will be described later.

The control unit CU has a function to receive image data from an external device (not illustrated) and control respective units that constitute the image forming apparatus 10 based on the image data. The specific functions of the control unit CU will be described in a description of the image forming operation, which will be described later.

Image Forming Operation

Next, a description will be given of the image forming operation by the image forming apparatus 10 according to the embodiment with reference to FIGS. 2 and 3.

First, the control unit CU that has received image data from an external device (not illustrated) causes the toner-image forming unit 50 to operate. Specifically, the control unit CU sends a remote signal for forming a toner image to the toner-image forming unit 50 (see FIG. 3). As a result, charging the photoreceptor 51 by the charging apparatus 52, exposing the photoreceptor 51 by the exposure apparatus 53 to form a latent image, and developing the latent image as a toner image by the developing device 54 form a toner image to the photoreceptor 51.

The control unit CU sends a remote signal for conveying the medium S to the conveyance device 40. Then, the conveyance device 40 sends the medium S into a transfer position, in accordance with timing where the toner image formed on the photoreceptor 51 reaches the transfer position (a portion where the photoreceptor 51 and the transfer roller 55 mutually contact) by rotation of the photoreceptor 51 around the shaft. As a result, the transfer roller 55 transfers the toner image formed on the photoreceptor 51 to the medium S, and the toner image is formed on the medium S.

Subsequently, the control unit CU sends a remote signal for fixing the toner image on the medium S to the fixing device 60. Then, the fixing device 60 fixes the toner image transferred to the medium S by the transfer roller 55 on the medium S. Consequently, the medium S where the toner image is fixed, namely, the medium S where an image is formed is discharged in the discharge tray 22, which is further on the downstream side in the conveyance direction, of the main body 20 by the conveyance device 40, and the image forming operation terminates.

Configuration of Main Part (Fixing Device)

Next, a description will be given of the configuration of the fixing device 60 that is a main part of the embodiment in detail with reference to FIGS. 4 to 6.

The fixing device 60 is constituted including a heating roller 61 (an exemplary heating body), a pressure roller 62

(an exemplary pressurizing body), a heat source 63, a temperature sensor 66, a separating unit 68, a housing HG (see FIG. 1), and a pair of side plates (not illustrated). The heating roller 61, the pressure roller 62, and the heat source 63 are each configured to be long-sized and are positioned to the pair of side plates, in a state where those longitudinal directions are aligned (with the apparatus depth direction) with one another. Then, the fixing device 60 is configured to be long-sized and is mounted to the main body 20 of the image forming apparatus 10, in a state where the longitudinal direction is aligned with the apparatus depth direction (see FIG. 1). The components other than the housing HG, which constitute the fixing device 60, are housed inside the housing HG.

Heating Roller

The heating roller 61 has a function to heat the toner image (the toner that constitutes the toner image) formed on the medium S by the toner-image forming unit 50 and the medium S. As illustrated in FIG. 4, the heating roller 61 is a roller constituted including a long-sized pipe 61A (a raw aluminum tube as one example) and an elastic layer 61B that covers an outer periphery of the pipe 61A. The elastic layer 61B has, as one example, a multi-layer structure configured with a surface layer and a primer layer. The surface layer covers the outer periphery of the pipe 61A. The primer layer is sandwiched between the pipe 61A and the surface layer to secure the surface layer to the pipe 61A. The surface layer of the embodiment is constituted of, as one example, a PFA tube. Compared with a surface layer of other materials, PFA is a material that relatively hardly causes the toner of the embodiment to attach. That is, the outer periphery of the heating roller 61 according to the embodiment includes a release layer against toner.

The heating roller 61 is driven by the driving source (not illustrated) to rotate around the shaft, while being heated by the heat source 63, which will be described later. Here, the arrow A in FIG. 4 indicates a rotation direction of the heating roller 61. Then, the heating roller 61 applies pressure to the medium S, where the toner image is formed and which is conveyed by the conveyance device 40, with the pressure roller 62 at a nip N, which will be described later. As a result, the heating roller 61 contacts the medium S where the toner image has been formed to heat the medium S while rotating around the shaft, applies pressure to the medium S, which passes through the nip N, with the pressure roller 62, and fixes the toner image to the medium S.

Flanges (not illustrated) are fitted into portions at both ends of the heating roller 61, and the heating roller 61 is bonded and secured to the respective flanges. Then, the respective flanges are rotatably supported by the pair of side plates via shafts (not illustrated) that are fitted into the respective flanges.

Pressure Roller

The pressure roller 62 has a function to apply pressure to the toner image (the toner that constitutes the toner image), which has been formed on the medium S by the toner-image forming unit 50, and the medium S, while sandwiching with the heating roller 61. The pressure roller 62 is a roller constituted of a long-sized shaft and a coating layer that covers its outer periphery and has elasticity (see FIG. 4). As illustrated in FIG. 4, the pressure roller 62 is arranged on the lower side of the heating roller 61 viewed from the apparatus depth direction. The above-described nip N means a contact portion, which is formed by the pressure roller 62 and the heating roller 61, of the pressure roller 62 and the heating roller 61. The pressure roller 62 is driven by the heating roller 61 to rotate around the shaft. Here, the arrow B in FIG. 4 indicates the rotation direction of the pressure roller 62.

Heat Source

The heat source 63 has a function to provide heat for the heating roller 61 to heat the medium S to the heating roller 61. The heat source 63 is, as one example, a bar-shaped (or long-shaped) halogen lamp.

Temperature Sensor

The temperature sensor 66 has a function to detect the temperatures of the heating roller 61. The temperature sensor 66 is, as one example, arranged opposed to the outer periphery of the heating roller 61 (see FIG. 4). The temperatures (the data on the temperatures) detected by the temperature sensor 66 are sent to the control unit CU at a determined cycle.

Separating Unit

The separating unit 68 has a function to separate the medium S after having passed through the nip N from the heating roller 61. As illustrated in FIG. 4, the separating unit 68 is ordinarily arranged in a state of being in contact with a portion that is outer periphery of the heating roller 61, is on the downstream side with respect to the nip N in the rotation direction (the arrow A direction) of the heating roller 61, and is on the upstream side with respect to the position where the temperature sensor 66 opposes. Here, the term of "ordinarily" means a case where the medium S is not in contact with the separating unit 68 itself, for example, a case where the fixing operation is not performed. In another word, the term of "ordinarily" means a case where separation claws 70 are not in contact with respect to the medium S after having passed through the nip N.

Figure 4:
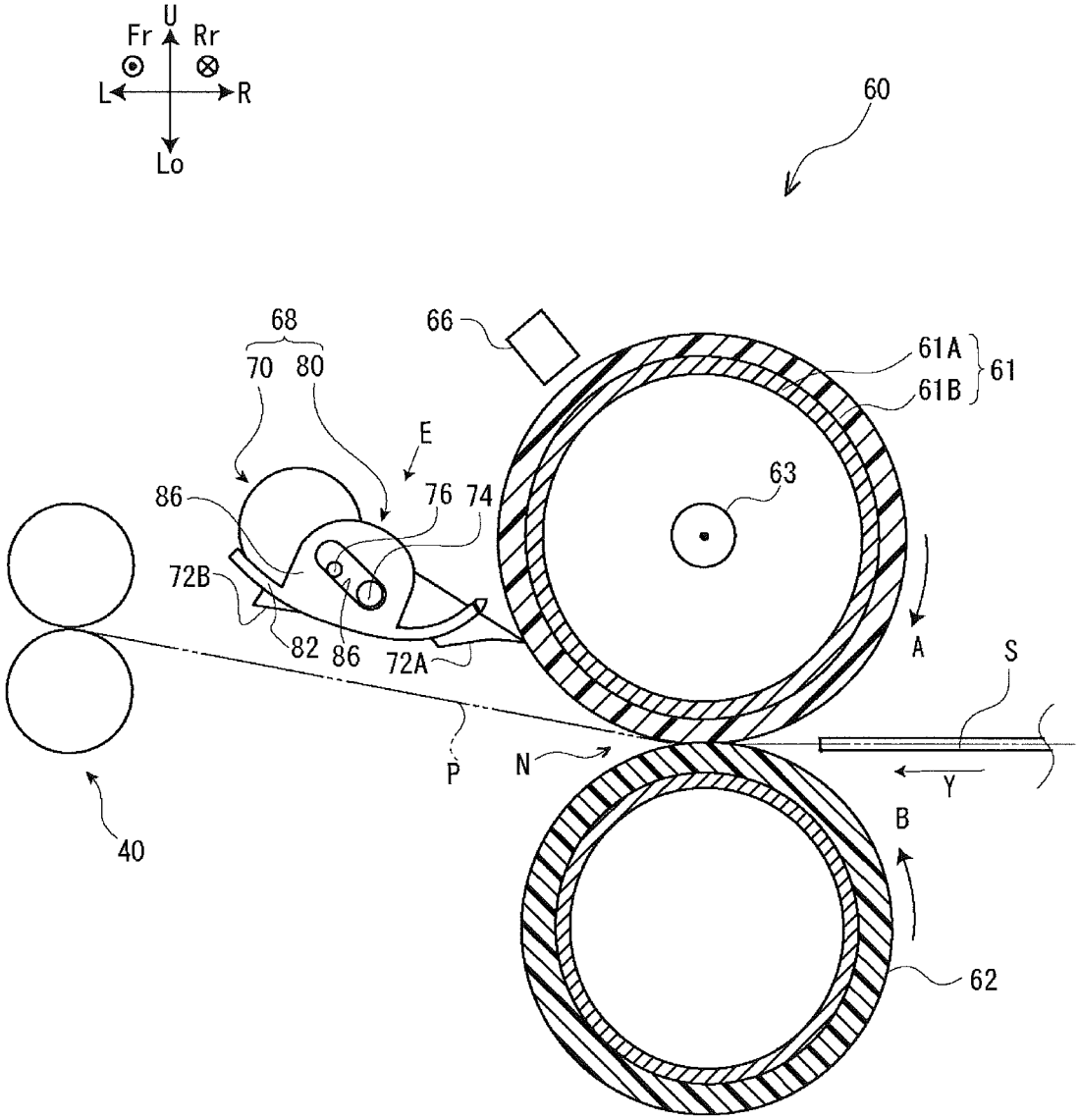
FIG. 4 illustrates a schematic diagram (a cross-sectional view) of a fixing device that constitutes the image forming apparatus according to the one embodiment viewed from a front side.
Figure 5:
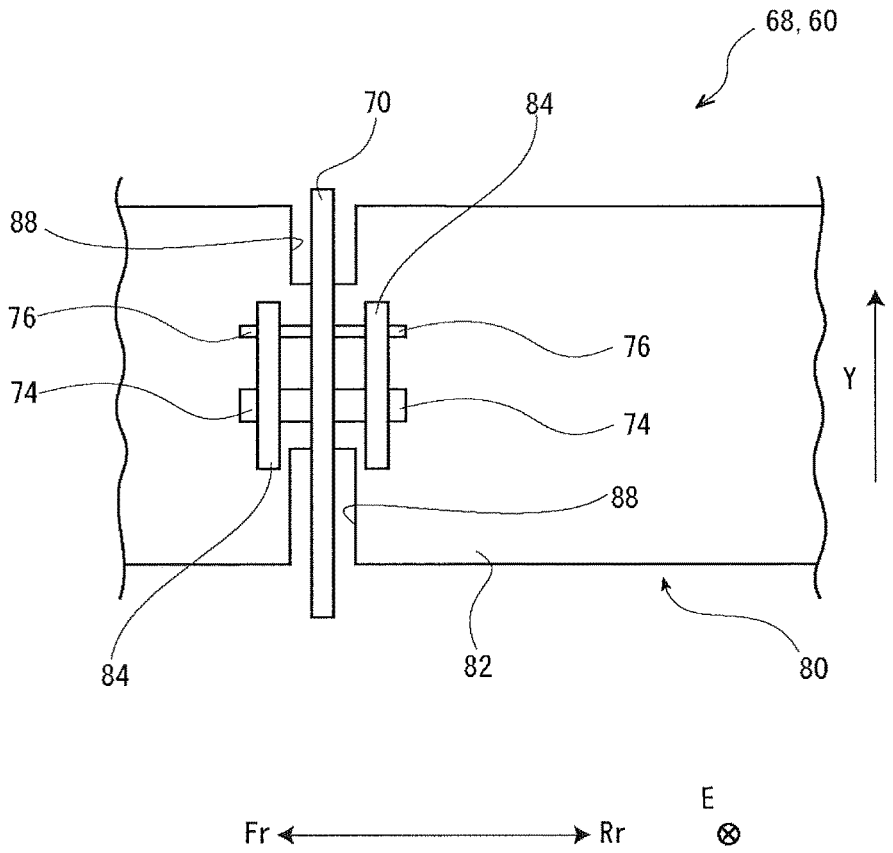
FIG. 5 illustrates a schematic diagram of a separating unit that constitutes the fixing device according to the one embodiment viewed from an arrow E direction in FIG. 4.
Figure 6:
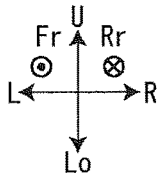
FIG. 6 illustrates a schematic diagram of a supporting member that constitutes the separating unit according to the one embodiment viewed from a front side.
Figure 6:
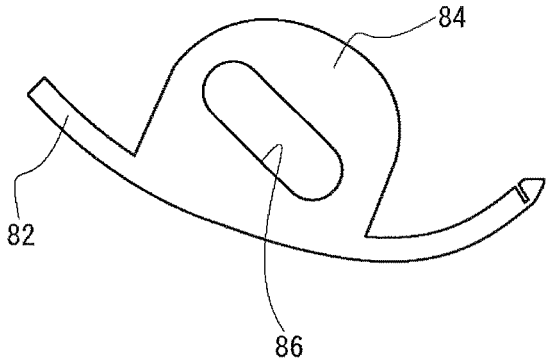

As illustrated in FIGS. 4 and 5, the separating unit 68 is constituted including the separation claws 70 and a support plate 80. While not illustrated in FIGS. 4 and 5, the plurality of separation claws 70 according to the embodiment are arranged along the apparatus depth direction (the axial direction of the heating roller 61) at a determined interval.

Separation Claw

The separation claw 70 has a function to contact the medium S after having passed through the nip N to separate the medium S from the heating roller 61. As illustrated in FIGS. 4, 5 and 7A to 7H, the separation claw 70 is configured to be a long-sized, plate-shaped member aligned with the conveyance direction (meaning the direction where the arrow Y in FIG. 4 points, and the passing direction of the medium S) of the medium S. As illustrated in FIG. 5, the separation claw 70 is arranged in a posture where its thickness direction is aligned with the axial direction of the heating roller 61.

As illustrated in FIGS. 4 and 7A to 7H, the separation claw 70 includes a plurality (two, as one example) of protrusions 72A and 72B where the distal end or the rear end of the medium S after having passed through the nip N contacts, in the lower portion of itself. Then, the plurality of protrusions 72A and 72B are located in a state where the two are arranged side by side along the conveyance direction of the medium S, in the lower portion of the separation claw 70. In the following description, of the plurality of protrusions 72A and 72B, assume that the protrusion on the upstream side of the conveyance direction of the medium S is the protrusion 72A, and the protrusion on the downstream side is the protrusion 72B.

Both sides of the separation claw 70 include a pair of column-shaped pins 74. Both sides of the separation claw 70 include a pair of pins 76 with a diameter smaller than the pin 74. Here, the pin 76 is arranged in a left upper side with respect to the pin 74 viewing the separation claw 70 from the front side, in an ordinary state (see FIG. 4).

Support Plate

The support plate 80 has a function to support the respective separation claws 70. As illustrated in FIG. 4, the support plate 80 ordinarily supports the respective separation claws 70 in a state where the respective separation claws 70 (the distal end of the respective separation claws 70) are brought into contacted with the heating roller 61 (the outer periphery of the heating roller 61).

The support plate 80 is configured to be a long-sized, plate-shaped member viewed from above (viewed from the arrow E direction in FIG. 4), as illustrated in FIG. 5. The support plate 80 is constituted of a curved plate 82 curved downward in a convex shape and projecting portions 84 projecting upward from the curved plate 82, viewed from the front side. As illustrated in FIG. 5, the projecting portions 84 are plate-shaped members that form a pair sandwiching the separation claw 70 in its thickness direction. The projecting portions 84 include a long-sized through-hole 86 penetrating from the left-upper side to the right-lower side, viewed from the front side (see, for example, FIGS. 4 and 5). The pin 74 and the pin 76 of the separation claw 70 are fitted into the through-hole 86 (see, for example, FIGS. 4 and 5).

In the curved plate 82, cutouts 88 are formed in the portions that overlaps with the protrusions 72A and 72B of the separation claw 70.

Relationship Between Separation Claw and Support Plate

As described above, a description has been given of the respective features about the separation claw 70 and the support plate 80 that constitute the separating unit 68, and then a description will be given of relationship between the separation claw 70 and the support plate 80.

In the separating unit 68 according to the embodiment, the respective separation claws 70 are supported by the support plate 80 with its posture determined by its own weight. Then, as illustrated in FIG. 4, in the ordinary state, the respective separation claws 70 are supported by the support plate 80 in a state where its distal end is brought into contact with the outer periphery of the heating roller 61. In this case, the pin 74 located in the separation claw 70 is positioned at the right-lower end portion of the through-hole 86, which is formed in the support plate 80, viewed from the front side (see FIG. 4). In contrast to this, the pin 76 is positioned at the portion between the center in the longitudinal direction and a left-upper end portion of the through-hole 86, viewed from the front side (see FIG. 4). That is, the respective separation claws 70 in the ordinary state can slide toward the left-upper side from the right-lower side, viewed from the front side. Thus, as illustrated in, for example, FIGS. 7B and 7D, which will be described later, for example, pressing the protrusions 72A and 72B by the distal end of the medium S, which is brought into contact with the protrusions 72A and 72B, causes the separation claw 70, which has been at the position of the ordinary state, to slide toward the left-upper side from the right-lower side, viewed from the front side. From another viewpoint, when the protrusions 72A and 72B are pressed by the medium S after having passed through the nip N, which is brought into contact with the protrusions 72A and 72B, the support plate 80 supports the respective separation claws 70 while sliding the respective separation claws 70 in a direction separating from the heating roller 61.

Fixing Operation

Next, a description will be given of the fixing operation (including a separation operation of the medium S by the separating unit 68) by the fixing device 60 according to the embodiment mainly with reference to FIGS. 7A to 7H.

Figure 3:
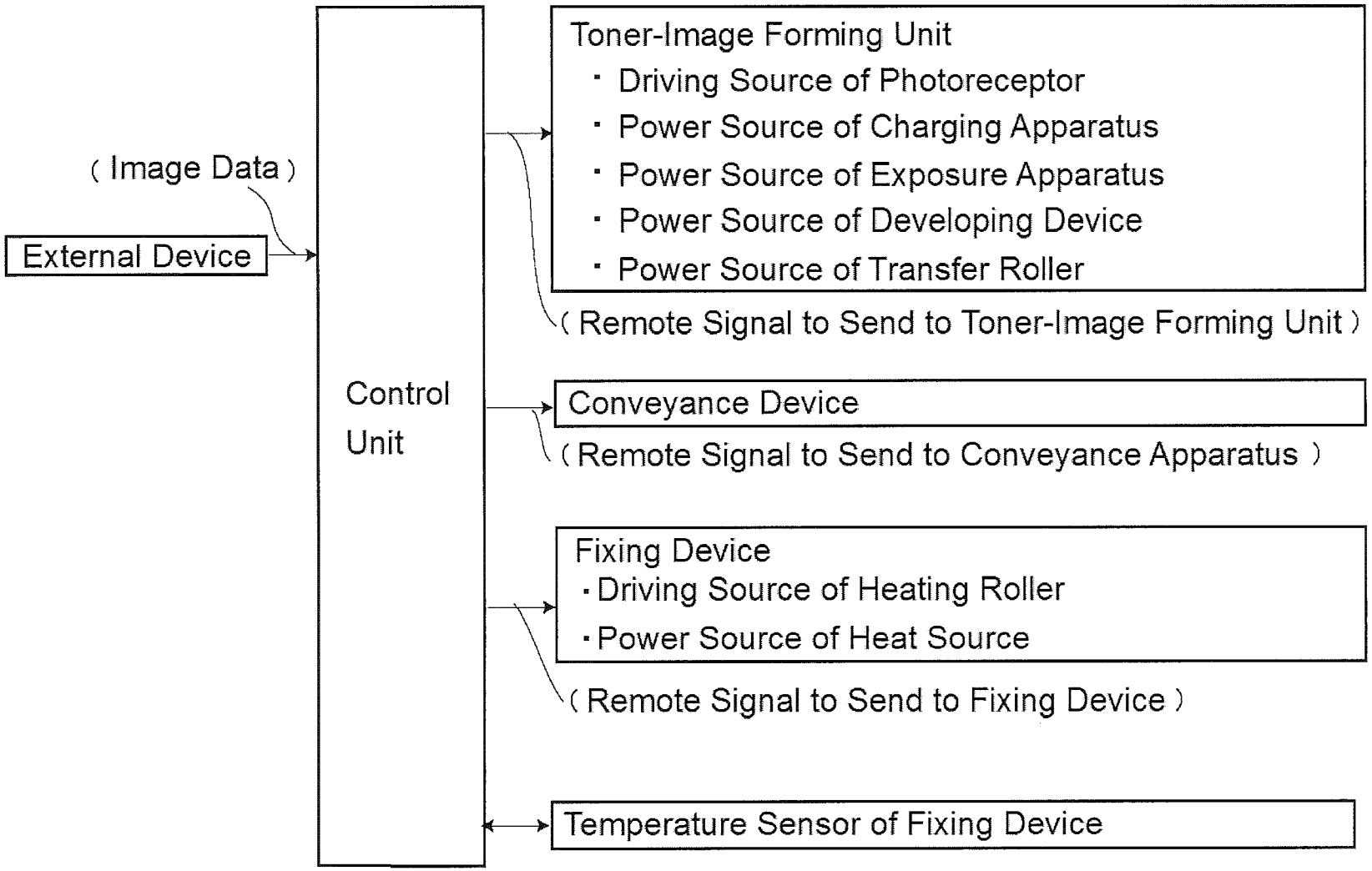
FIG. 3 illustrates a block diagram indicating a relationship between a control unit that constitutes the image forming apparatus according to the one embodiment and respective components that constitutes the image forming apparatus.

The control unit CU that has received image data from an external device (not illustrated) sends a remote signal to the fixing device 60 (see FIG. 3). Then, the control unit CU drives the driving source (not illustrated) of the heating roller 61 to rotate the heating roller 61 in the arrow A direction (see FIG. 4). In association with this, the pressure roller 62 is driven by the heating roller 61 to rotate in the arrow B direction (see FIG. 4). The control unit CU applies voltage to the power source of the heat source 63 to cause the heat source 63 to start applying heat to the heating roller 61 (see FIG. 3).

Figure 7A:
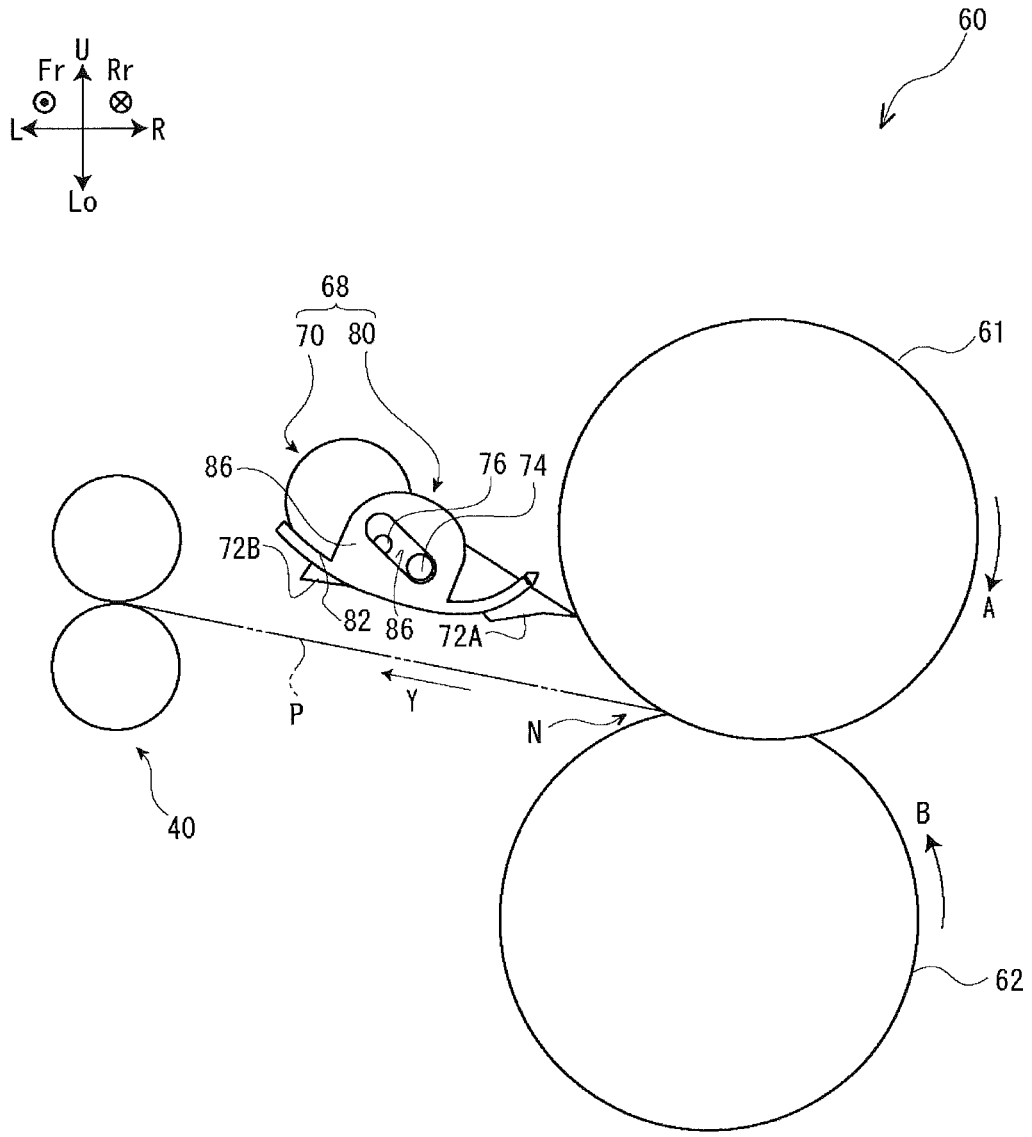
FIG. 7A illustrates a drawing for describing a fixing operation of the fixing device according to the one embodiment, and schematically illustrates a state before a medium reaches a nip.

Subsequently, in accordance with timing where the heating roller 61 of the fixing device 60 reaches a determined heating temperature, the medium S, where the toner image is formed by the toner-image forming unit 50, is conveyed to the nip N of the fixing device 60 by the conveyance device 40 along the conveyance direction (the arrow Y direction), as illustrated in FIGS. 4 and 7A.

Figure 7B:
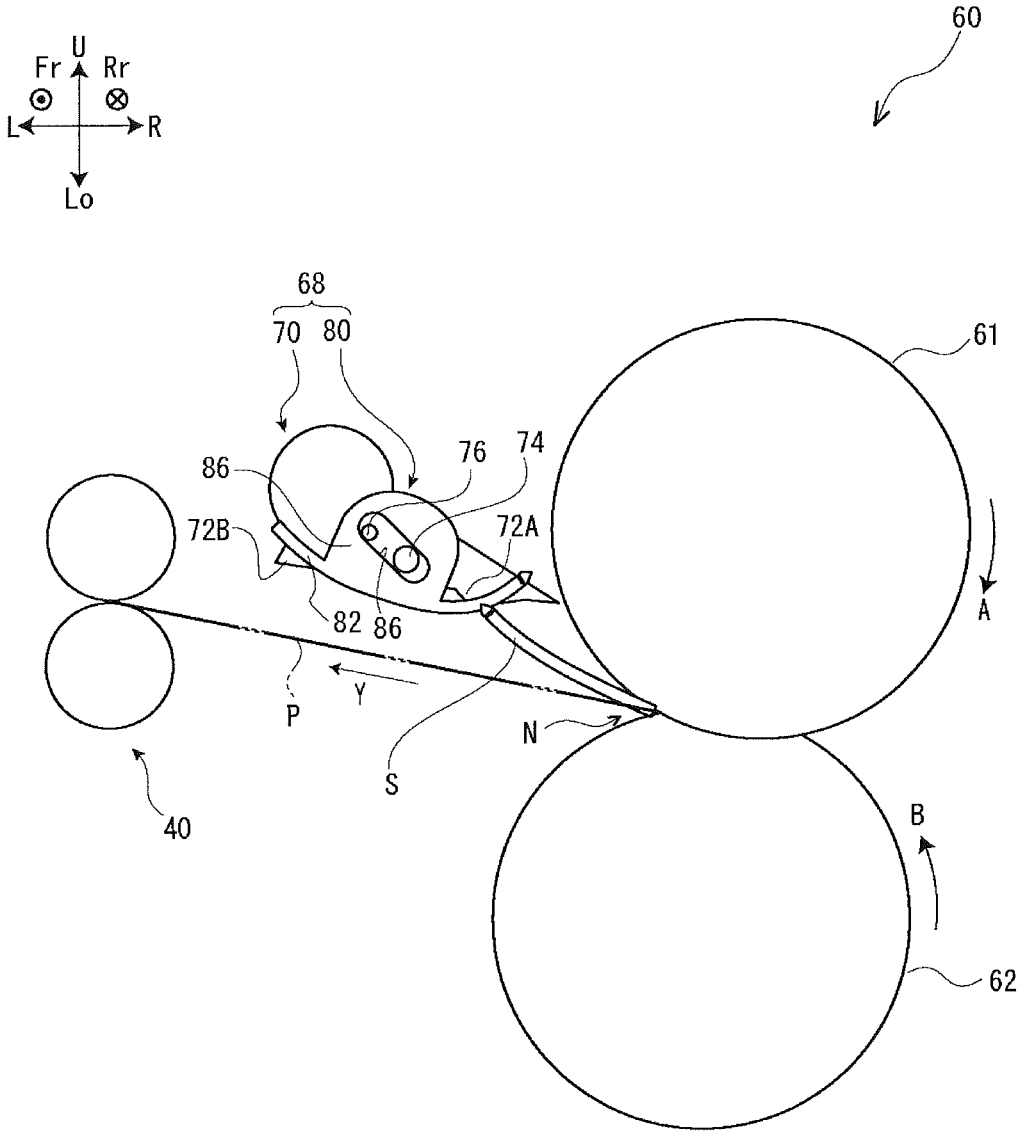
FIG. 7B illustrates a drawing for describing the fixing operation of the fixing device according to the one embodiment, and schematically illustrates a state (a state after FIG. 7A) where after the medium has passed the nip, a distal end of the medium is in contact with a protrusion on an upstream side of a passing direction of the medium in a separation claw, and the medium presses the protrusion.

Subsequently, after having passed through the nip N, the distal end of the medium S is brought into contact with the protrusion 72A of the separation claw 70 (see FIG. 7B). Then, the medium S presses the protrusion 72A with its distal end. As a result, the medium S causes the separation claw 70, which has been in contact with the heating roller 61, to slide in a direction separating from the heating roller 61 (see FIG. 7B).

Figure 7C:
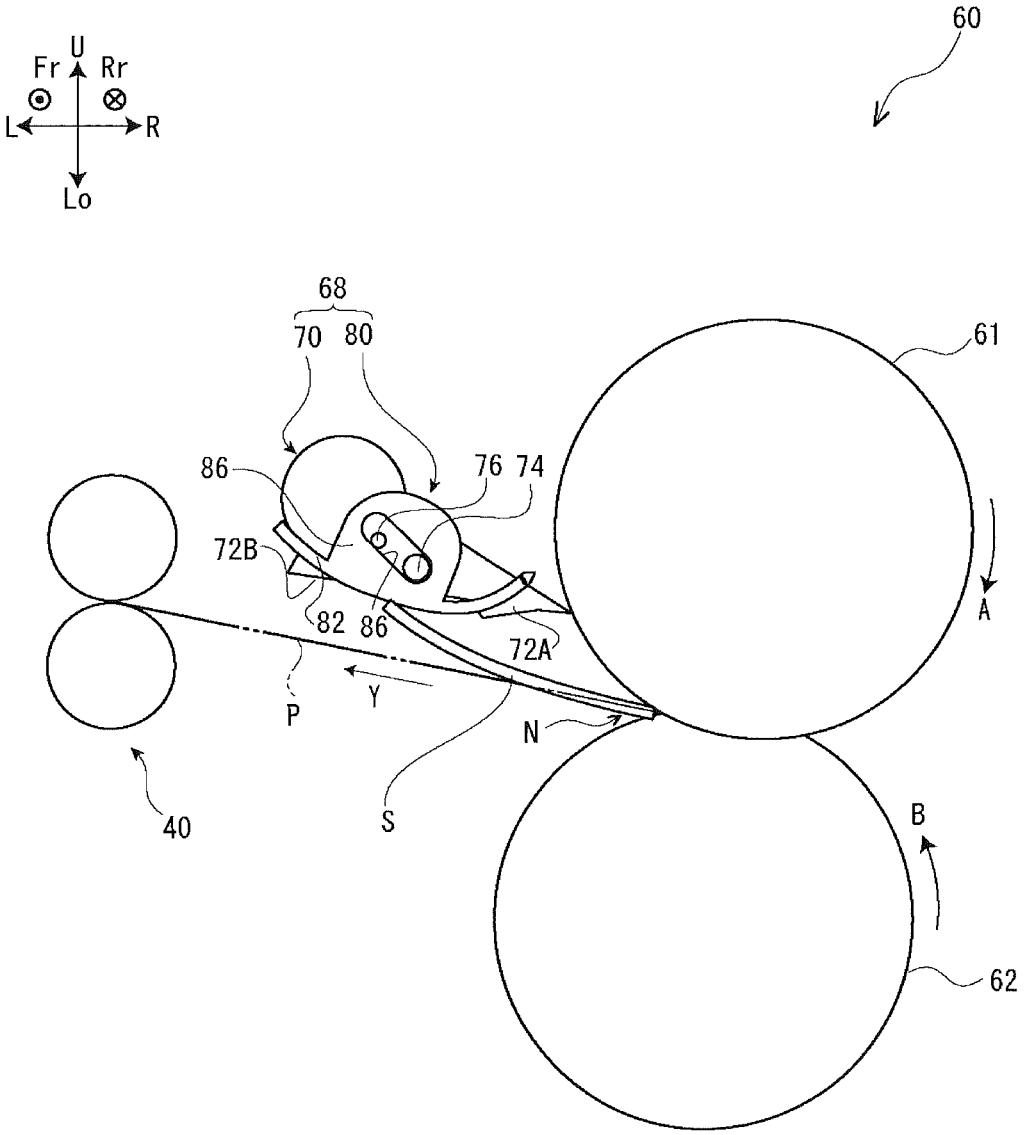
FIG. 7C illustrates a drawing for describing the fixing operation of the fixing device according to the one embodiment, and schematically illustrates a state (a state after FIG. 7B) where the distal end of the medium, which has been in contact with the protrusion on the upstream side of the passing direction of the medium in the separation claw, is displaced to a downstream side with respect to the protrusion.

Subsequently, the distal end of the medium S is conveyed toward the downstream side in the conveyance direction (see FIG. 7C). As a result, the distal end of the medium S, which has pressed the protrusion 72A, moves away from the protrusion 72A, and the separation claw 70 returns to the ordinary position by its own weight (see FIG. 7C).

Figure 7D:
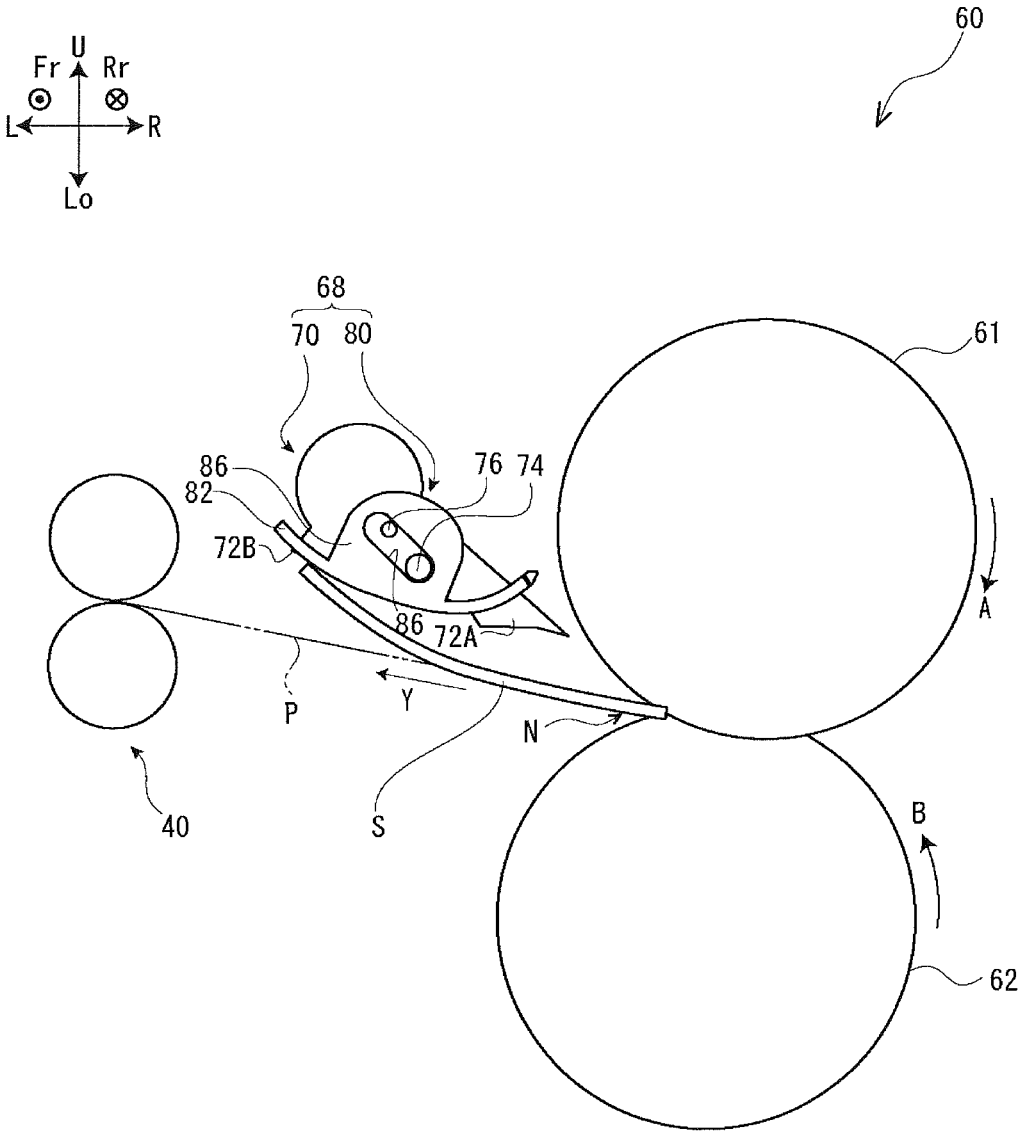
FIG. 7D illustrates a drawing for describing the fixing operation of the fixing device according to the one embodiment, and schematically illustrates a state (a state after FIG. 7C) where the distal end of the medium is in contact with the protrusion on the downstream side of the passing direction of the medium in the separation claw, and the medium presses the protrusion.
Figure 7E:
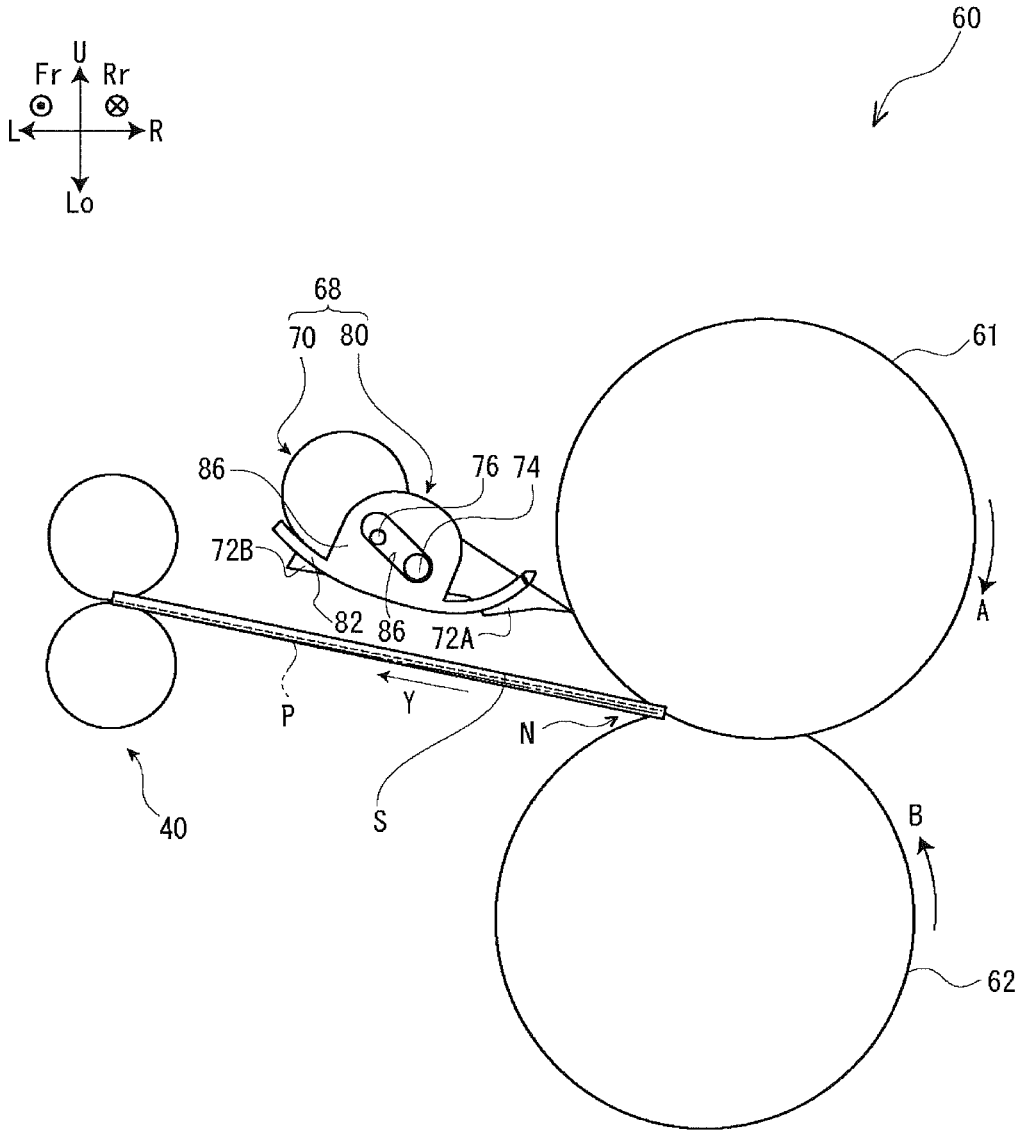
FIG. 7E illustrates a drawing for describing the fixing operation of the fixing device according to the one embodiment, and schematically illustrates a state (a state after FIG. 7D) where the distal end of the medium, which has been in contact with the protrusion on the downstream side of the passing direction of the medium in the separation claw, is displaced to the downstream side with respect to the protrusion.

Subsequently, the distal end of the medium S is brought into contact with the protrusion 72B of the separation claw 70 (see FIG. 7D). Then, the medium S presses the protrusion 72B with its distal end. As a result, the medium S causes the separation claw 70, which has returned to the ordinary position to be in contact with the heating roller 61, to slide in the direction separating from the heating roller 61 (see FIG. 7D). Then, the distal end of the medium S is sandwiched and conveyed by a conveyance roller pair on the downstream side in the conveyance direction of the medium S relative to the fixing device 60, among the conveyance roller pairs configuring the conveyance device 40 (see FIG. 7E). In this case, the separation claw 70 separates from the medium S and returns to the ordinary position by its own weight (see FIG. 7E).

Figure 7F:
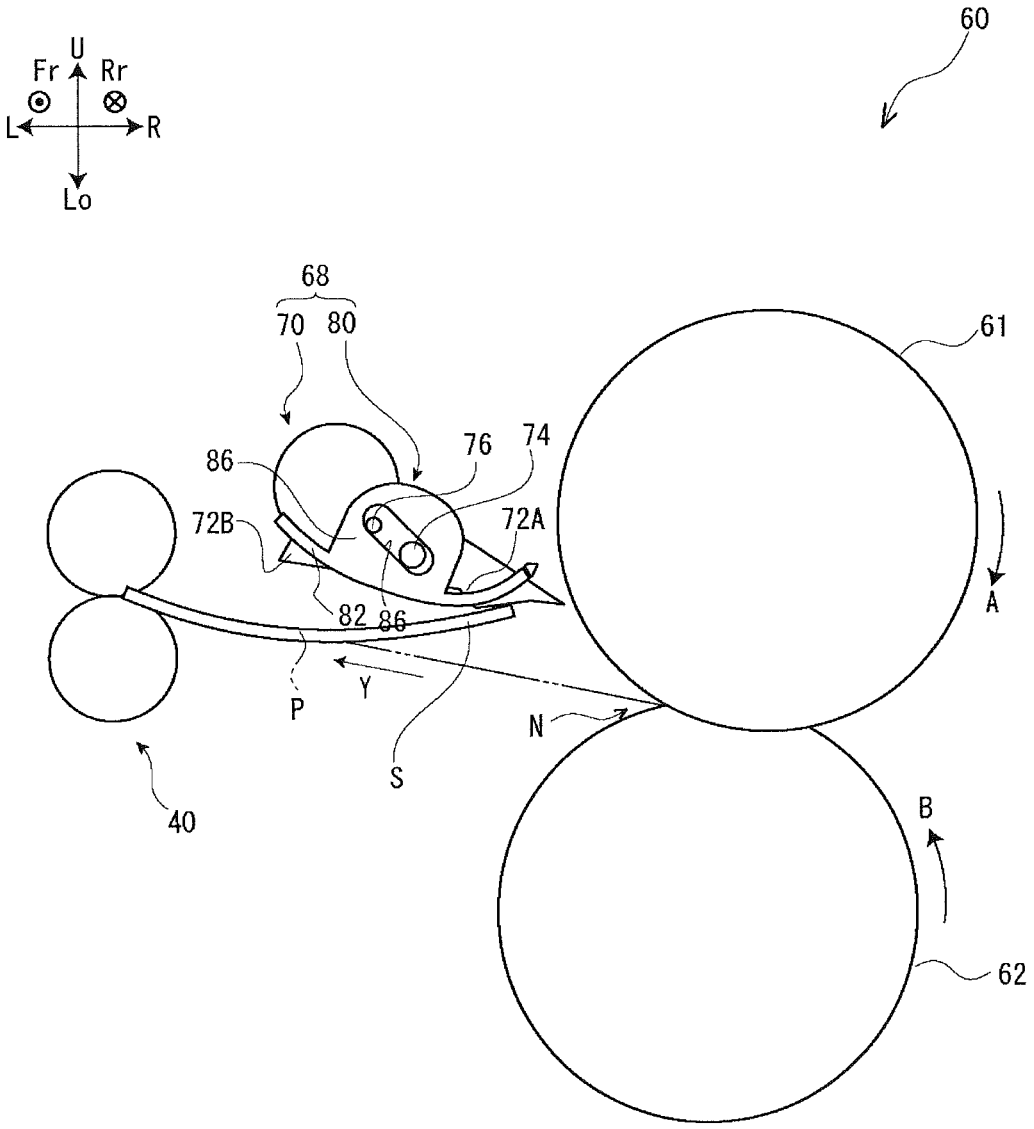
FIG. 7F illustrates a drawing for describing the fixing operation of the fixing device according to the one embodiment, and schematically illustrates a state (a state after FIG. 7E) where a rear end of the medium is in contact with the protrusion on the upstream side of the passing direction of the medium in the separation claw, and the medium presses the protrusion.

Subsequently, after having passed through the nip N, the rear end of the medium S is brought into contact with the protrusion 72A of the separation claw 70 (see FIG. 7F). Then, the medium S presses the protrusion 72A with its distal end. As a result, the medium S causes the separation claw 70, which has been in contact with the heating roller 61, to slide in the direction separating from the heating roller 61 (see FIG. 7F).

Figure 7G:
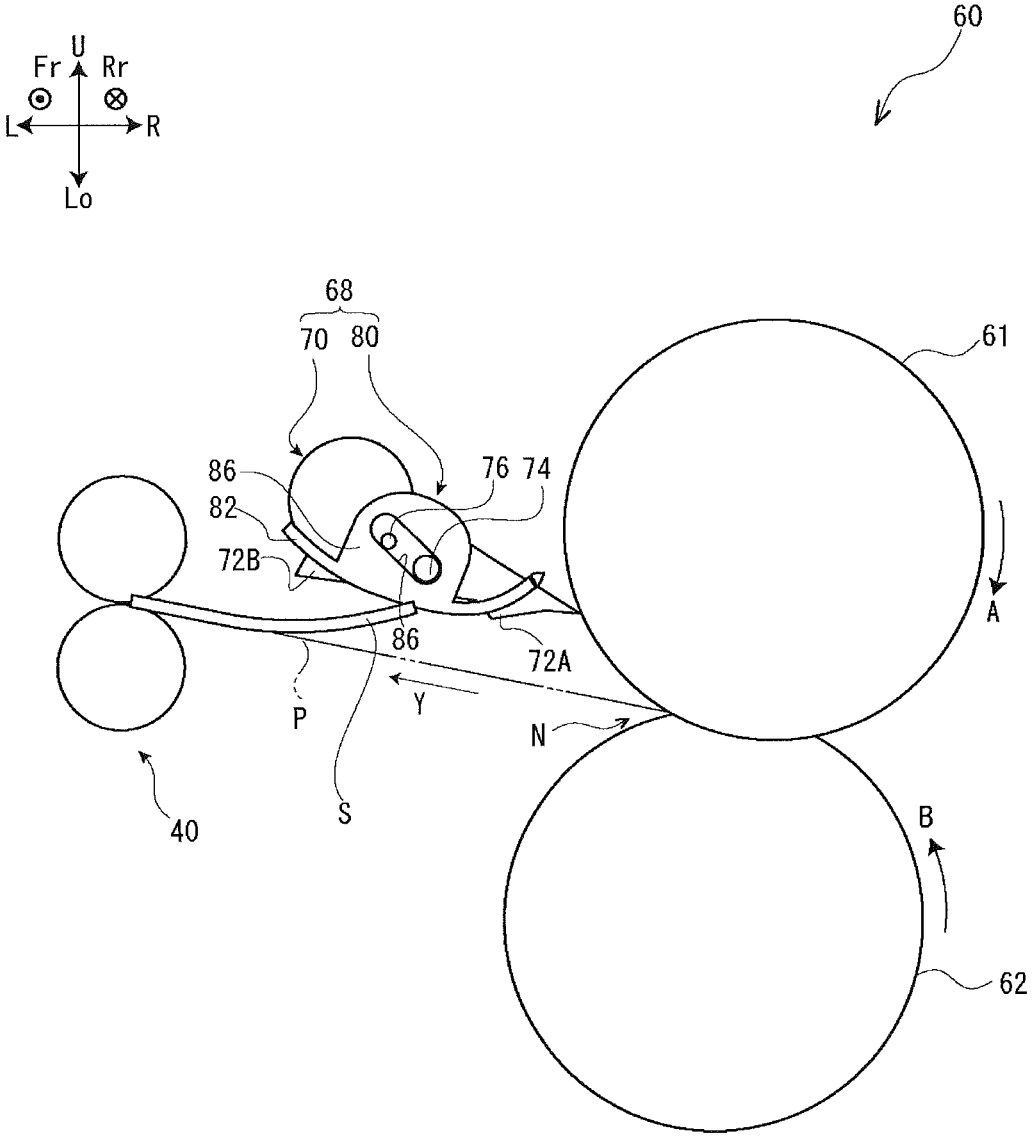
FIG. 7G illustrates a drawing for describing the fixing operation of the fixing device according to the one embodiment, and schematically illustrates a state (a state after FIG. 7F) where the rear end of the medium, which has been in contact with the protrusion on the downstream side of the passing direction of the medium in the separation claw, is displaced to the downstream side with respect to the protrusion.

Subsequently, the rear end of the medium S is conveyed toward the downstream side in the conveyance direction (see FIG. 7G). As a result, the rear end of the medium S, which has pressed the protrusion 72A, moves away from the protrusion 72A, and the separation claw 70 returns to the ordinary position by its own weight (see FIG. 7G).

Figure 7H:
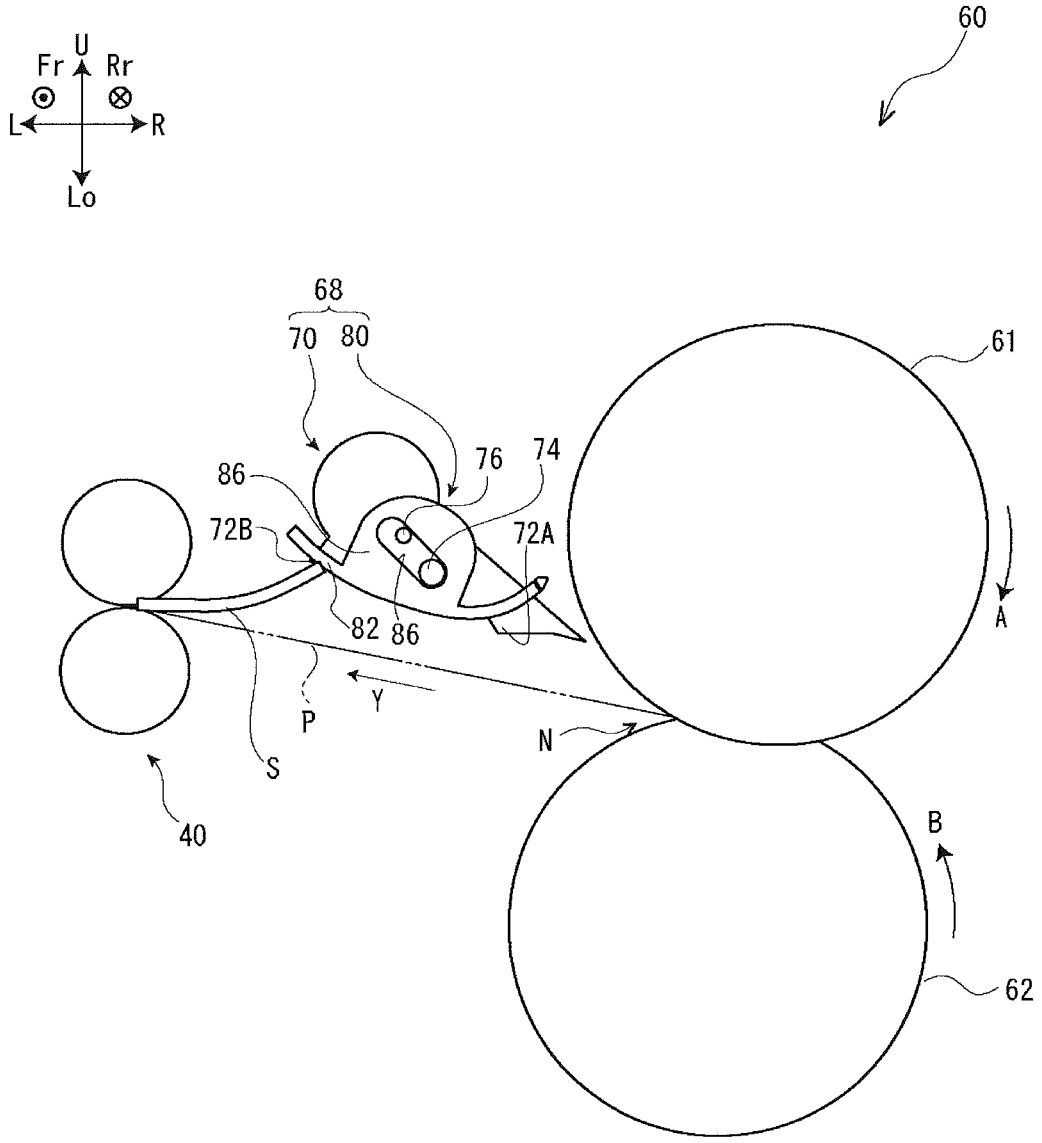
FIG. 7H illustrates a drawing for describing the fixing operation of the fixing device according to the one embodiment, and schematically illustrates a state (a state after FIG. 7G) where the rear end of the medium is in contact with the protrusion on the downstream side of the passing direction of the medium in the separation claw, and the medium presses the protrusion.

Subsequently, the rear end of the medium S is brought into contact with the protrusion 72B of the separation claw 70 (see FIG. 7H). Then, the medium S presses the protrusion 72B with its rear end. As a result, the medium S causes the separation claw 70, which has returned to the ordinary position to be in contact with the heating roller 61, to slide in the direction separating from the heating roller 61 (see FIG. 7H). Then, when the rear end of the medium S moves away from the protrusion 72B, the separation claw 70 returns to the ordinary position by its own weight (not illustrated).

Then, when all the mediums S are discharged from the fixing device 60, the control unit CU halts driving of the heating roller 61 and application of voltage to the heat source 63 to cause the fixing device 60 to terminate the fixing operation.

Effects

Next, a description will be given of the effects according to the embodiment with reference to the drawings.

First Effect

Different from the case of the embodiment, for example, when a separation claw is biased by a spring or similar member and does not separate from the heating roller 61 even when being brought into contact with the medium S having passed through the nip N (hereinafter referred to as a comparative configuration, and not illustrated), toner or similar material, which offsets to attach onto the heating roller 61, attaches onto the distal end of the separation claw. As a result, the toner that has attached onto the distal end of the separation claw accumulates to grow to a toner lump and stains an image surface (a surface where an image is formed in the medium S) in the medium S (a fixing failure).

In contrast to this, the separation claw 70 according to the embodiment includes the protrusions 72A and 72B, and the separation claw 70 is slid in the direction separating from the heating roller 61 during a period when the medium S is brought into contact with the protrusions 72A and 72B to press the protrusions 72A and 72B (see FIGS. 7B, 7D, 7E, 7F and 7H). Then, similarly to the case of the above-described comparative configuration, also in the case of the embodiment, the toner or similar material that offsets to attach onto the heating roller 61 attaches onto the distal end of the separation claw 70. However, in the case of the embodiment, compared with the case of the above-described comparative configuration, a period when the distal end of the separation claw 70 is in contact with the heating roller 61 is short.

Consequently, the fixing device 60 according to the embodiment ensures the reduced growth of the toner, which has attached onto the separation claw 70 causing the medium S to be separated from the heating roller 61, to a toner lump. In association with this, the fixing device 60 according to the embodiment ensures the reduced fixing failure where the toner lump stains the image surface of the medium S. The image forming apparatus 10 according to the embodiment ensures a reduced image formation failure associated with the fixing failure.

Second Effect

In the case of the embodiment, the posture of the respective separation claws 70 is determined by being supported by the support plate 80 by its own weight. Thus, in the case of the embodiment, the respective separation claws 70 ordinarily (during a period when the distal end of the respective separation claws 70 is in contact with the outer periphery of the heating roller 61) does not apply a load equal to or more than a load caused by its own weight to the heating roller 61 (see FIG. 4).

Therefore, in the fixing device 60 according to the embodiment, compared with a case where the posture of the respective separation claws 70 is determined supported by the support plate 80 while being biased by a spring or similar member (hereinafter referred to as a second comparative configuration), the load by the respective separation claws 70 relative to the heating roller 61 is small. In association with this, compared with the above-described second comparative configuration, the fixing device 60 according to the embodiment hardly damages the outer periphery (the surface layer) of the heating roller 61. This effect is particularly effective when the release layer is located in the outer periphery of the heating roller 61, as the case of the embodiment.

Third Effect

In the fixing device 60 according to the embodiment, the plurality of protrusions 72A and 72B that the separation claw 70 includes are located along the conveyance direction (the passing direction of the medium S) of the medium S (see FIGS. 4 and 7A to 7H). Thus, during a period when the fixing operation is performed on one medium S, since the distal end and the rear end of the one medium S are brought into contact with the respective protrusions 72A and 72B, the respective separation claws 70 separate from the outer periphery of the heating roller 61 four times in total.

Therefore, compared with a case where the respective separation claws 70 include a single protrusion, the fixing device 60 according to the embodiment ensures reduced growth of the toner, which has attached onto the separation claw 70 for separating the medium S from the heating roller 61, to a toner lump. In the fixing device 60 according to the embodiment, compared with a case where the respective separation claws 70 include a single protrusion, the load by the respective separation claws 70 relative to the heating roller 61 is small. This effect is particularly effective when the release layer is located in the outer periphery of the heating roller 61, as the case of the embodiment.

Fourth Effect

In the fixing device 60 according to the embodiment, the pin 76 located in the respective separation claws 70 has a smaller diameter than the pin 74 (see, for example, FIG. 4). Thus, when the protrusions 72A and 72B of the separation claw 70 are pressed by the distal end or the rear end of the medium S, and the respective separation claws 70 are slid (see FIGS. 7B, 7D, 7E, 7F, and 7H), the respective separation claws 70 are swingable not only in the longitudinal direction of the through-hole 86 of the support plate 80 but also, for example, by a determined angle (meaning the angle determined by relationship between the diameter of the pin 76 and a width in a lateral direction of the through-hole 86) with the pin 74 as a rotation shaft.

Therefore, compared with a case where the respective separation claws 70 can be slid only in a determined linear direction, the fixing device 60 according to the embodiment easily separates the respective separation claws 70 from the heating roller 61.

As described above, while the disclosure has been described with the above-described embodiments as examples, the technical range of the disclosure is not limited to the above-described embodiments. For example, the technical range of the disclosure includes the following configuration.

For example, the separation claw 70 according to the embodiment has been described to include the plurality of protrusions 72A and 72B (see, for example, FIG. 4). However, because even a configuration that includes only any one of the plurality of protrusions 72A and 72B in the separation claw 70 is a constitution that achieves the above-described first, second, and fourth effects, this configuration is included in the technical range of the disclosure.

The separation claw 70 according to the embodiment has been described to include the two protrusions 72A and 72B (see, for example, FIG. 4). However, as long as at least two protrusions 72A and 72B are included in the separation claw 70, a configuration that includes three or more protrusions is also included in the technical range of the disclosure. This configuration can be a constitution that achieves the above-described first to fourth effects.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

What is claimed is:

1. A fixing device comprising:

a heating body that heats a medium where a toner image is formed while the heating body rotates around a shaft;

a pressurizing body that forms a nip with the heating body and applies pressure to the medium that passes through the nip while the pressurizing body rotates around a shaft;

a separation claw that includes two protrusions on an upstream side and a downstream side along a conveyance direction of media that contacts the medium after having passed through the nip, the separation claw separating the medium from the heating body; and a supporting member that supports the separation claw in a state of causing the separation claw to contact with the heating body, wherein the supporting member supports the separation claw while the supporting member causes the separation claw to slide in a direction separating from the heating body when the medium is brought into contact with the protrusion to press the protrusion, wherein the separation claw is supported by the supporting member by an own weight of the separation claw itself at a time of non-contact relative to the medium after having passed through the nip, wherein the separation claw slides in a direction separating from the heating body when the distal end of the medium contacts with and presses the upstream side protrusion after having passed through the nip, subsequently the distal end of the medium is conveyed toward the downstream side in the conveyance direction, as a result the distal end of the medium, which has passed the upstream side protrusion, moves away from the upstream side protrusion, and the separation claw returns to the ordinary position by its own weight, subsequently the distal end of the medium is brought into contact with the downstream side protrusion of the separation claw, then the medium presses the downstream side protrusion with its distal end, as a result the medium causes the separation claw, which has returned to the ordinary position to be in contact with the heating body, to slide in the direction separating from the heating body, then the distal end of the medium is sandwiched and conveyed by a conveyance roller pair on the downstream side in the conveyance direction of the medium relative to the fixing device, among the conveyance roller pairs configuring the conveyance device, and the separation claw separates from the medium and returns to the ordinary position by its own weight, subsequently after having passed through the nip, the rear end of the medium is brought into contact with the upstream side protrusion of the separation claw, then the medium presses the upstream side protrusion with its distal end, as a result the medium causes the separation claw, which has been in contact with the heating body, to slide in the direction separating from the heating body, subsequently, the rear end of the medium is conveyed toward the downstream side in the conveyance direction, as a result the rear end of the medium, which has pressed the upstream side protrusion, moves away from the upstream side protrusion and the separation claw returns to the ordinary position by its own weight, subsequently the rear end of the medium is brought into contact with the downstream side protrusion of the separation claw, then the medium presses the downstream side protrusion with its rear end, as a result the medium causes the separation claw, which has returned to the ordinary position to be in contact with the heating body to slide in the direction separating from the heating body, then when the rear end of the medium moves away from the downstream side protrusion, the separation claw returns to the ordinary position by its own weight.

2. The fixing device according to claim 1, wherein an outer periphery of the heating body includes a release layer.

3. An image forming apparatus comprising:

a forming unit that forms a toner image to a medium; and the fixing device according to the claim 1, the fixing device heating and pressurizing the medium where the toner image is formed by the forming unit to fix the toner image on the medium.

* * * * *